United States Patent [19]

Mittal

[11] 4,321,020

[45] Mar. 23, 1982

[54] FLUID PUMP

[75] Inventor: Faquir C. Mittal, Audubon, Pa.

[73] Assignee: Sperry Corporation, New York, N.Y.

[21] Appl. No.: 103,880

[22] Filed: Dec. 17, 1979

[51] Int. Cl.[3] ..... F04B 19/14; F04B 17/00

[52] U.S. Cl. ..... 417/320; 417/410

[58] Field of Search ..... 417/48, 417, 320, 410; 415/5, DIG. 2

[56] References Cited

U.S. PATENT DOCUMENTS

| | | | |
|---|---|---|---|
| Re. 24,497 | 7/1958 | Vincent | 417/320 |
| 2,478,051 | 8/1949 | Nordell | 417/320 |
| 2,875,695 | 3/1959 | Justice | 417/410 X |
| 3,496,871 | 2/1970 | Stengel | 417/410 |

*Primary Examiner*—Carlton R. Croyle
*Assistant Examiner*—Edward Look

[57] ABSTRACT

There is disclosed a low-cost, axial fluid pump which does not involve the conversion of rotary to linear motion. The fluid pump herein is based on the principle of successively using a ball, that may be obtained from a reservoir of similar balls, as a piston within an enclosed cylinder. The ball is made to traverse the cylinder's length by simple non-motor means, thereby compressing the fluid. Upon pressurizing the fluid, the ball eventually returns to the reservoir and a new ball from the reservoir repeats the compression cycle. The pump of this invention is adapted for low pressure, low rate of flow, and low cost applications.

3 Claims, 3 Drawing Figures

FLUID PUMP

BACKGROUND OF THE INVENTION

1. Field of the Invention

The invention relates to the field of fluid pumps and, in particular, to a type referred to as axial piston pumps.

2. Description of the Prior Art

All known axial piston pumps operate on a principle that a piston reciprocating in a bore will draw in fluid at a first pressure on its return stroke and expel it under a second, higher, pressure on its forward stroke. The return stroke in the above-mentioned prior art piston pumps require additional structures for operation, such as a connecting rod and crank. These additional structures, of course, unduly complicate the piston pump, make it expensive to manufacture, and are a factor to be considered with respect to their reliability. Modern day fluid pumps are also complicated by their use of motors, gears and solenoids which are subject to breakdown.

Another shortcoming of the known prior art pump devices is that, because of the return stroke, the piston's operation is relatively slow. In view of the unique nature of the present invention wherein no return stroke exists, it will be characterized by rapidity of operation.

Finally, there is a dearth in the prior art of axial fluid pumps that generate a low pressure differential at a low flow rate and which are also of low cost. It is believed that fluid pumps of the above characteristics are not readily available in the marketplace because present day technology, which utilizes cranks, rods, gears and motors, is not able to build a pump with the above specifications, i.e., low cost, low flow rate and low pressure differential.

SUMMARY OF THE INVENTION

A fluid pump is provided which has a racetrack configuration wherein one of its straight sections comprises a pump stage or cylinder. A plurality of contiguous and metallized balls fill the track in a serial fashion, exclusive of the cylinder. The section of the racetrack configuration exclusive of the cylinder will be referred to herein as a feedback section or track. First and last balls of the serial type ball arrangement within the feedback track are utilized such that the last ball provides sealing for the cylinder during a compression stroke, whereas the first ball is used as a piston to compress the fluid within the cylinder.

The pump's compression cycle functions by energizing the first ball so that it traverses the length of the cylinder, thereby pressurizing the fluid within the cylinder which is then released at an outlet positioned at an upper part of the cylinder. In effect, the first ball, after traversing the cylinder during the compression stroke, causes a chain reaction to occur amongst the serially-arranged balls in the feedback track in the following manner. The first ball impinges upon and thereby replaces the last ball (i.e., the ball which provided sealing during the compression stroke), thus sealing the upper part of the cylinder for the next compression stroke. In other words, the first ball acts as a piston during a first compression stroke, and becomes a sealing device for a subsequent compression stroke. In the act of replacing the last ball with the first ball, there is a chain reaction in the feedback track which causes a ball which was contiguous to the first ball before it traversed the cylinder's length to assume the previous first ball's position.

This new first ball is now in a position to become a piston during the next compression stroke.

Certain advantages accrue in the present invention because of its unique principle of operation. Thus, energy for the compression cycle and for sealing is supplied to the balls by means of an electrical voice coil. The voice coil has no moving parts and is relatively simple to operate and manufacture vis-a-vis an electric motor or solenoid, which are employed in most axial pumping devices.

The instant invention is also characterized by simplicity in that the balls, which are employed as pistons in the fluid pump of this invention, are not connected to any crank and rod actuating mechanism, as are pistons of the known prior art. This simplicity of operation provides an economical mode of operation, which is also a characteristic of this invention. Other features and benefits will become readily apparent upon gaining a full understanding of this invention.

DESCRIPTION OF THE PREFERRED EMBODIMENT

Figure 1:
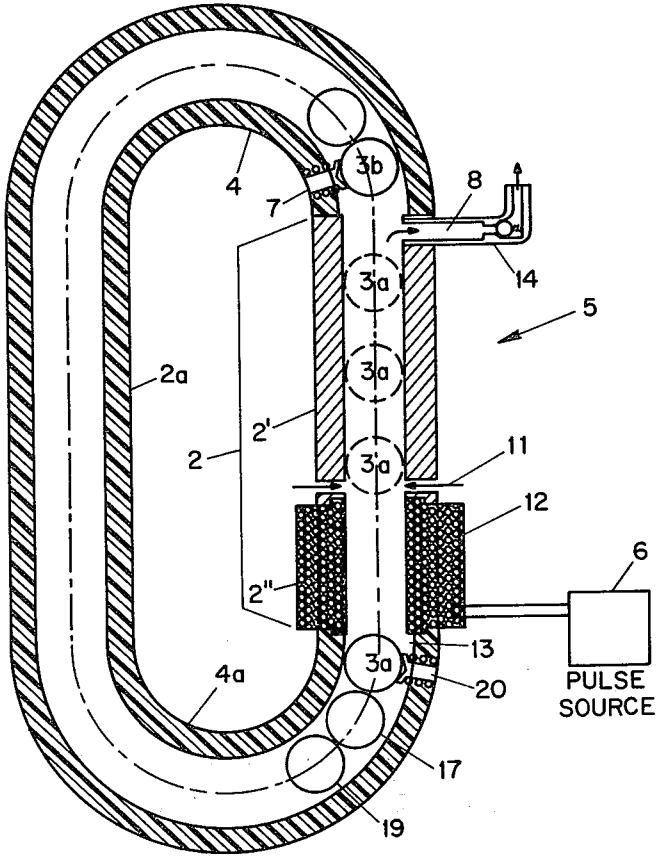
FIG. 1 shows an axial fluid pump arrangement which has a racetrack configuration.

Referring now to FIG. 1 of the drawings, which is a sectional view of a fluid pump arrangement 5, there is depicted an enclosed member having a circular cross section which is conformed into a racetrack configuration. For ease of reference, the racetrack configuration has two straight sections, 2, 2*a* and two semicircular sections, 4, 4*a*. The sections 2*a*, 4 and 4*a* are fabricated out of a molded plastic such as nylon. The straight section 2, however, is made such that a portion 2' thereof is fabricated of stainless steel, whereas the remaining straight portion 2'' is an electrical voice coil 12. The reason for this arrangement will be discussed in greater detail in a later pararagraph.

The stainless steel section 2' is utilized as a cylinder, in which ambient air at a pressure of 14.7 psia. is compressed or pressurized upon gaining entrance thereto from an intake passage 11, which is located at a low end of the cylinder 2', as viewed in the drawing. An intake passage opposite passage 11 is shown to indicate that ambient air may be drawn into the cylinder 2' from both sides or either side. An exhaust outlet 8 is also provided at an upper end of the cylinder 2'. The exhaust outlet is connected to a uni-directional valve 14 which only permits air within the cylinder 2' to be exhausted when compressed to a differential pressure for which the fluid pump is designed. In the preferred embodiment the pump 5 is designed for a differential pressure of 0.5 psi (i.e., 15.2 psia).

Located between the plastic portion of the curved section 4*a* and the stainless steel straight section 2' is a voice coil 12, which is bonded and keyed between the two sections. As is well known in electrical arts, a voice coil 12 is able to generate a strong magnetic field within its interior air core when it is energized by means of an electrical current supplied by a D.C. pulse source 6.

A spherical piston 3*a*, which is one-half inch in diameter in the preferred embodiment, is utilized with the cylinder 2′ to provide compression of the ambient air fluid which flows therein via the inlet valve 11. The spherical piston is a very accurately dimensioned ball whose diameter is maintained within a tolerance of 5 microinches. The ball 3*a* may be of a solid magnetizable metal cross section or of a hollow or solid plastic cross section with a thin magnetizable surface coating. In the preferred embodiment, this coating will be approximately 5 mils but the thickness will vary, depending upon the forces which are to be applied to the sphere. The cylinder 2′ is made of stainless steel so that it may be accurately machined to a close tolerance which will receive the spherical ball 3*a* such that leakage between the ball and cylinder wall during a compression stroke is minimized. In other words, the spherical piston 3*a* and the cylinder 2′ are matched within a close tolerance to eliminate any leakage. It should be noted hereat that the cross sectional dimensions of the metal cylinder portion 2′ has a smaller diameter from the molded nylon plastic sections 2*a*, 4, 4*a*, of the feedback track and a slightly smaller diameter from the straight section 2″ wherein the voice coil 12 is located. The reason for this dimensional difference is that ball 3*a* should be able to freely move within the pump's feedback track comprising sections 2*a*, 4, and 4*a*, whereas the ball 3*a* when acting as a piston within cylinder 2′ must be matched with a close tolerance fit to prevent fluid leakage. The opening within section 2″ through the voice coil 12 may be made slightly larger in diameter than the diameter of cylinder 2′ in order to facilitate acceleration of the ball 3*a* through the cylinder 2′.

Although a plurality of contiguous spheres fill (not shown) the feedback or return section of the pump's racetrack configuration 5, only one sphere at a time is used as a piston, and is shown for illustrative purpose in the drawing as ball 3*a*. In its quiescent state, ball 3*a* is maintained at an appropriate position at an entrance 13 to the straight section 2 by the plurality of contiguous balls that fill the pump's feedback section (i.e., 4, 2*a*, 4*a*), as well as by detent 20. The sealing of the cylinder 2′ at its upper end is provided by a ball 3*b* which is maintained in position by means of a detent 7, which is located into a side of the feedback track 4. It will be shown in later paragraphs that the activation of the piston ball 3*a* through the cylinder 2′ will impinge upon the ball 3*b*, which it then will replace. Ball 17 will, in turn, replace ball 3*a* to become the next piston for a repetitive compression cycle.

Referring now to the pump's operation, a force is produced on the sphere 3*a* so that it is propelled through the cylinder 2′ in order to compress the ambient air which had entered through the intake passage 11. Various positions of the ball 3*a* are depicted in dotted form as it is propelled through the cylinder 2′. The ball 3*a* is also propelled with sufficient force through cylinder 2′ so as to impinge upon the ball 3*b*, which is held in position by the detent 7, in order to replace same. A force F, which propels the ball 3*a* through cylinder 2′, is generated by the voice coil 12 when it is energized by a current pulse from a pulse source 6. The magnitude of the magnetic force F produced by an energizing of the voice coil 12 is approximately proportional to a number of ampere-turns (NI) that are produced thereby. In other words, the force F is approximately equal to the number of turns (N) in the coil 12 multiplied by current (I) flowing in each turn. This relationship is expressed mathematically as follows:

$$F = ma\alpha NI$$

where (m) equals mass and (a) equals acceleration.

When the sphere 3*a* is located near entrance 13 to the section 2″ (i.e., at the lower end of voice coil 12), it is in a position to be thrust with an upward motion, as viewed in FIG. 1, by means of the magnetic field produced by voice coil 12. The ability to impart an upward momentum to the ball 3*a* by means of the force F of the voice coil 12 will be discussed below.

Figure 2A:
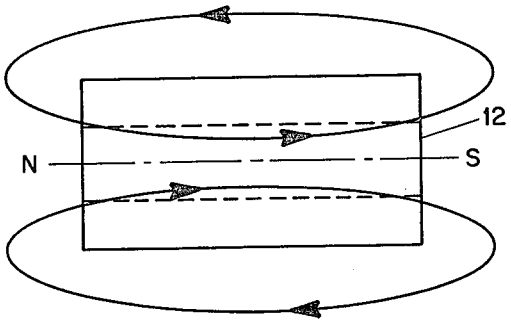
FIG. 2*a* depicts a magnetic field emanating from a voice coil when energized by a pulse source in FIG. 1.
Figure 2B:
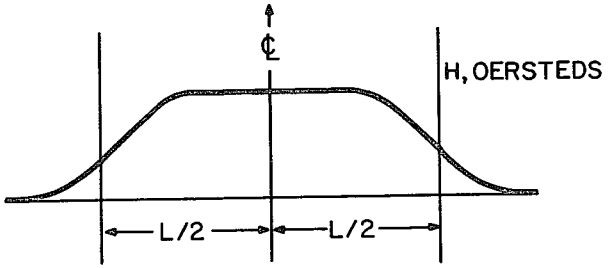
FIG. 2*b* is a graph of magnetic intensity H with respect to various positions along the length of the energized voice coil shown in FIGS. 1 and 2*a*.

The energizing of the voice coil 12 is by means of the pulse source 6 which causes a magnetic field to be generated with respect to voice coil 12, which produces a north-south pole at its ends in a manner shown in FIG. 2*a*. The magnetic field shown in FIG. 2*a* is of sufficient magnitude to magnetize the ball 3*a* (FIG. 1) so that it is given an upward thrust. Another way of expressing this phenomenon is that the energizing of voice coil 12 will produce a magnetic gradient with respect to ball 3*a* which will accordingly impart to it an upward motion as viewed in FIG. 1. FIG. 2*b* is a graph of magnetic intensity H in oersteds along an ordinate versus distance along an abscissa wherein $L_1$ is a leftward distance in centimeters from a centerline (℄) of the coil 12 to one of its ends, and $L_2$ is a rightward distance in centimeters from the same centerline to the remaining end of the coil. A magnetic gradient is therefore defined as a rate of change in oersteds/centimeter with respect to the coil's distance $L_1$, $L_2$ from its centerline. The oersteds/centimeter is zero near the center of the voice coil 12 and is maximum near the ends. Beyond the ends of the voice coil 12, the magnetic field and gradient eventually drops off to zero.

Accordingly, the energizing of the voice coil 12 by a D.C. pulse from the source 6 causes a magnetic gradient to be developed with respect to the ball 3*a* when it is positioned near the entrance 13 of straight section 2″, as shown in FIG. 1. In other words, when the ball 3*a* is positioned as shown in FIG. 1, it will be located within the magnetic gradient or where there is change of magnetic intensity H of voice coil 12. As long as the ball 3*a* is within the magnetic gradient of voice coil 12, there will be a tendency for the voice coil's magnetic field to pull the sphere 3a toward the centerline (℄). Thus, the magnetic gradient imparts a kinetic energy to the ball 3*a* such that it is propelled in an upward direction, as viewed in FIG. 1, toward ball 3*b* and in so doing compresses the fluid in the cylinder 2′. Therefore, the kinetic energy of the ball 3*a* is absorbed by the fluid within the cylinder 2′ and this results in a higher pressure level of the fluid.

It should be understood from FIGS. 2*a* and 2*b* that the magnetic gradient exists approximately a third of the way inwardly from each end of the voice coil 12, after which it becomes constant. This is significant in that it is necessary that the voice coil 12 be pulsed by the D.C. current from source 6 for a duration while the ball 3*a* will be under the influence of the magnetic gradient; that is, the magnetic gradient extending in one direction away from location 13 towards ball 3*a*, to an opposite direction from location 13 extending inwardly one-third the length of coil 12. The magnetic gradient extending on the other side of the coil has no influence on the movement of sphere 3*a* and, therefore, for all intents and purposes, may be ignored. Accordingly, as soon as the ball 3 has traversed approximately one-third of the distance inwardly (i.e., upwardly as shown in FIG. 1) from the end of the coil 12 from the quiescent position 13, the pulse signal from source 6 is turned off. It should be noted that if the pulse were not turned off at a point where the magnetic gradient ceased to exist (i.e., where the oersteds/centimeters dH/dL become zero), the ball 3*a* would have a tendency to lose some momentum and, therefore, the pump would not function with optimum efficiency. A determination of the exact location of the magnetic gradient as well as the duration of the D.C. pulse from the source is achieved by experimentation as well as calculation. As previously mentioned, the ball 3*a* is propelled upwardly as viewed in FIG. 1 by the magnetic gradient to compress the fluid in the cylinder 2′, which is released at the exhaust outlet 8. The kinetic energy imparted to the ball 3*a* by the magnetic gradient is sufficient to strike the ball 3*b* so that it is replaced by ball 3*a*. Ball 3*a* is maintained in position by the detent 7. All the balls in the feedback loop comprising sections 4, 2*a* and 4*a* are moved by the striking of ball 3*b* by 3*a* and, therefore, ball 17 replaces ball 3*a*. Ball 17 will be maintained in position by detent 20. The cycle is then repeated by generating another magnetic gradient via the application of another D.C. pulse by source 6, which will impart a momentum to ball 17. Ball 17 will, therefore, be propelled upwardly to compress the new ambient fluid that enters cylinder 2′ and therefore will impinge upon ball 3*a*. Ball 17 will be held in position by detent 7. The remaining balls in the feedback loop will again be serially moved so that a new ball 19 will replace ball 17 for purposes of repeating the above described compression cycle.

The fluid pump which is designed in accordance with principles set forth above is capable of developing a fluid differential of 0.5 psi at a flow rate of 4 cfm (cubic feet per minute), and at a relatively low cost. Although the above invention has been described with certain specifications in mind, that is, low cost, flow rate and pressure differential, it is understood that the principles contained herein are suitable for higher pressure differentials and flow rates.

I claim the following:

1. Apparatus for developing a single pressurized fluid comprising:

(a) an enclosed member which is conformed into a racetrack configuration having a circular cross-section wherein a section of one leg of said racetrack configuration is utilized as a pressurizing chamber;

(b) fluid inlet means coupled near one end of said pressurizing chamber;

(c) fluid outlet means coupled near a second end of said pressurizing chamber;

(d) magnetic field generating means having a circular cross-section substantially similar to that of said pressurizing chamber coupled to the pressurizing chamber and occupying the remaining section of said leg of said racetrack configuration;

(e) feedback means comprising the remainder of said enclosed racetrack configuration member coupled to both said ends of said leg (f) a plurality of magnetizable pistons in touching relationship located in said feedback means, wherein one such piston is positioned within said feedback means to pressure seal one end of said chamber, and a second such piston is positioned in the feedback means to seal the other end of said chamber in proximity to said magnetic field generating means;

(g) pulse means for applying a signal to said generating means to produce a momentary magnetic field with respect to said magnetizable piston in proximity thereto such that said piston is propelled through said chamber thereby pressurizing said fluid at said fluid outlet means, said propelled piston impinging upon said piston sealing the opposite end of said chamber whereby each piston is advanced a distance within said feedback means such that a compression cycle may be repeated.

2. Apparatus comprising:

(a) a pump stage, said pump stage comprising a hollow enclosed cylinder having a circular cross section and having an entrance and exit for compressing a single fluid;

(b) feedback means interconnecting said exit with said entrance;

(c) a plurality of contiguous, spherical, magnetizable pistons located within said feedback means from said entrance to said exit, said feedback means storing said plurality of piston and allowing said pistons to recirculate through said pump stage, one of said plurality of pistons being located at the cylinder exit for sealing off said cylinder;

(d) a fluid inlet means located near the entrance of said cylinder;

(e) a fluid outlet means located near the exit of said cylinder;

(f) means for positioning one of said plurality of pistons at the entrance of said cylinder for sealing off said cylinder;

(g) electrical pulse means positioned in juxtaposition to said piston at the entrance of said cylinder for imparting momentary magnetic energy thereto to cause said piston to move through said cylinder and impinge upon said piston sealing off said exit, whereby fluid within said cylinder is pressurized for release at said fluid outlet means, said impinging piston replacing said impinged piston for re-sealing off said exit, and said impinged piston imparting energy to the plurality of stored pistons in said feedback means so that a piston nearest said entrance re-seals said cylinder for repeating the cycle.

3. A fluid pump apparatus, comprising:

(a) an enclosed, uniformly dimensioned member;

(b) means for allowing entrance of a single fluid which is to be pressurized within said member;

(c) means removed from said first mentioned means for unidirectionally allowing pressurized fluid to exit from said member;

(d) at least three magnetizable means movable within said member, one said magnetizable members being initially positioned with respect to said exit means to prevent passage of said fluid past said member;

(e) a second said magnetizable members being positioned with respect to said entrance means to prevent passage of fluid past said member, (f) pulse means for imparting momentary magnetic energy to said second magnetizable member to move same within said enclosed member in the direction of said first magnetizable member whereby said fluid within said enclosed member becomes pressurized and removed at said fluid exit means and said second moveable member replacing said first removable member, feedback means for allowing said first magnetizable member to allow a third said magnetizable member to replace said second magnetizable member whereby the pressure cycle may be repeated.

* * * * *